US006149559A

United States Patent [19]

Mackey

[11] Patent Number: 6,149,559

[45] Date of Patent: Nov. 21, 2000

[54] VARIABLE RESISTANCE EXERCISE DEVICE

[76] Inventor: Teri R Mackey, 266 Las Lomas Dr., Novato, Calif. 94949

[21] Appl. No.: 09/334,282

[22] Filed: Jun. 16, 1999

[51] Int. Cl.[7] ..... A63B 69/00

[52] U.S. Cl. ..... 482/124; 482/904; 482/127

[58] Field of Search ..... 482/127, 124, 482/904, 121, 129

[56] References Cited

U.S. PATENT DOCUMENTS

| | | | |
|---|---|---|---|
| 4,544,155 | 10/1985 | Wallenbrock et al. | 482/124 |
| 5,269,512 | 12/1993 | Crowson et al. | 482/127 |
| 5,486,149 | 1/1996 | Smith et al. | 482/120 |
| 5,626,544 | 5/1997 | Foresto | 482/124 |

*Primary Examiner*—Jerome W. Donnelly

[57] ABSTRACT

Variable Resistance Exercise Device with a resistance mechanism comprised of a housing, spring reel, extension cable and resistance applying knob. A strap helps attach the resistance mechanism to a persons arm or leg. An eye bolt or bracket is attached to a wall. A retaining clip attaches to the wall bracket at the end of the cable of the resistance mechanism. An alternate embodiment where the resistance mechanism is removably attached to a wall at one end and a user retaining or holding means attached to said cable at the opposite end. A preferred embodiment includes wherein said housing has a padded portion on its underside where it interfaces the users arm or leg.

2 Claims, 8 Drawing Sheets

VARIABLE RESISTANCE EXERCISE DEVICE

BACKGROUND OF THE INVENTION

This invention relates generally to the field of exercise devices, and more particularly to a variable resistance exercise device.

Many means of exercising exist for improving ones muscular tone and for producing an aerobic workout. In my U.S. Pat. No. 5,876,310 issued on Mar. 2, 1999, I describe an upper body exercise device that consists of a pair of variable resistance elements each incorporated into a hand grip. A retractable cable protrudes from one end of each hand grip and each cable is attached at its opposite end to a belt like device that the user wears around his or her mid section. The user then can swing his or her arms while walking or running and receive a resistance type workout for his or her upper body at the same time the lower body is being exercised by the walking or running activity. While the upper body exercise as described above provides a useful function, it is only embodied in conjunction with the associated belt so that it is essentially a portable workout device that affects only the upper body.

The user can not use the device to exercise parts of the lower body. Furthermore the user can not take advantage of the use of a stationary wall to create an opposition force to the exercise being done.

SUMMARY OF THE INVENTION

The primary object of the invention is to provide a variable resistance exercise device that can be easily used in conjunction with an existing wall.

Another object of the invention is to provide a variable resistance exercise device in which the resistance mechanism can be either worn by the user or attached to a wall.

Other objects and advantages of the present invention will become apparent from the following descriptions, taken in connection with the accompanying drawings, wherein, by way of illustration and example, an embodiment of the present invention is disclosed.

Variable Resistance Exercise Device comprising: a resistance mechanism comprised of a housing, spring reel, extension cable and resistance applying knob, a strap that helps attach said resistance mechanism to a persons arm or leg, an eye bolt or bracket attached to a wall that removably retains a retaining clip attached to the end of said cable of said resistance mechanism, and an alternate embodiment where said resistance mechanism is removably attached to a wall at one end and to a user retaining or holding means attached to said cable at the opposite end.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
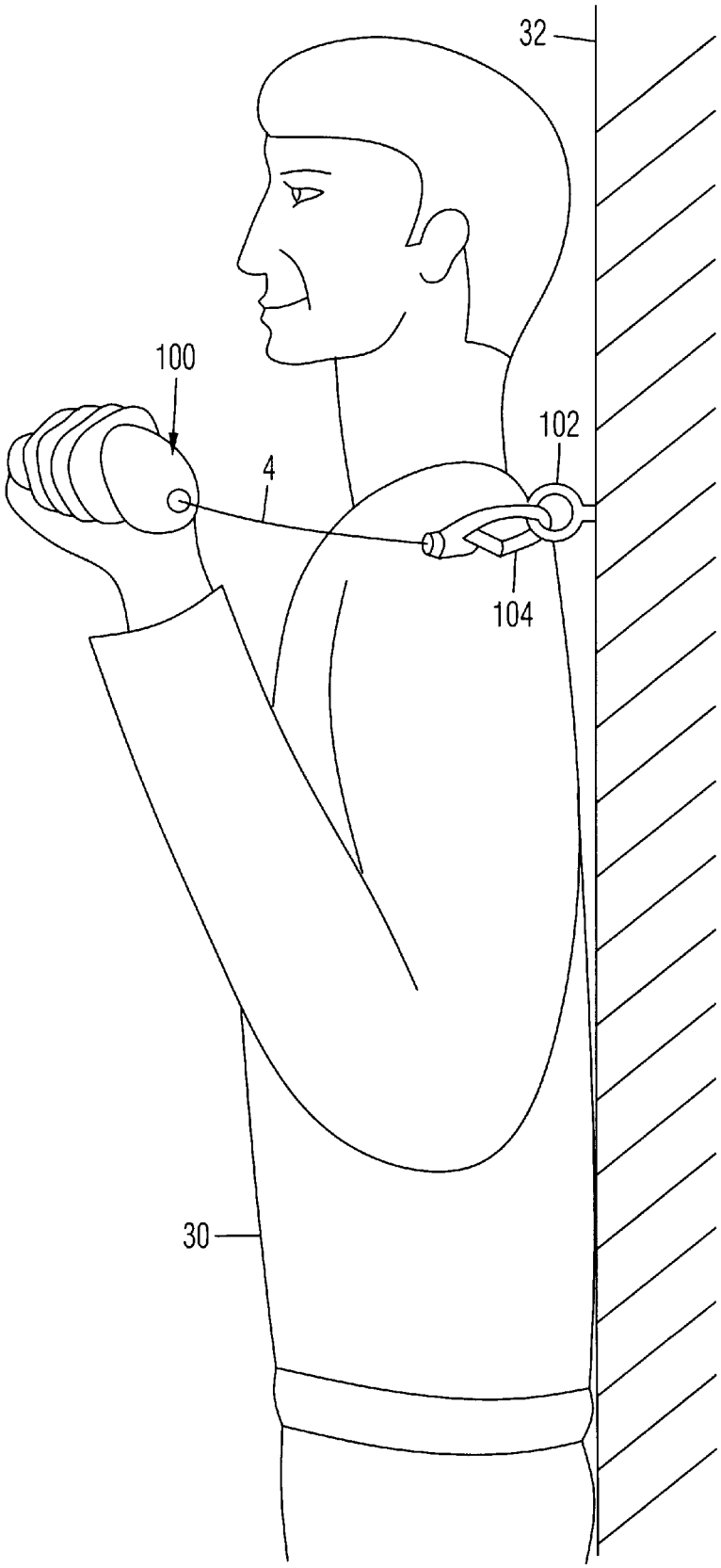
FIG. 1 is a side view of a person using the variable resistance exercise device of the present invention for doing extension type arm exercise.
Figure 2:
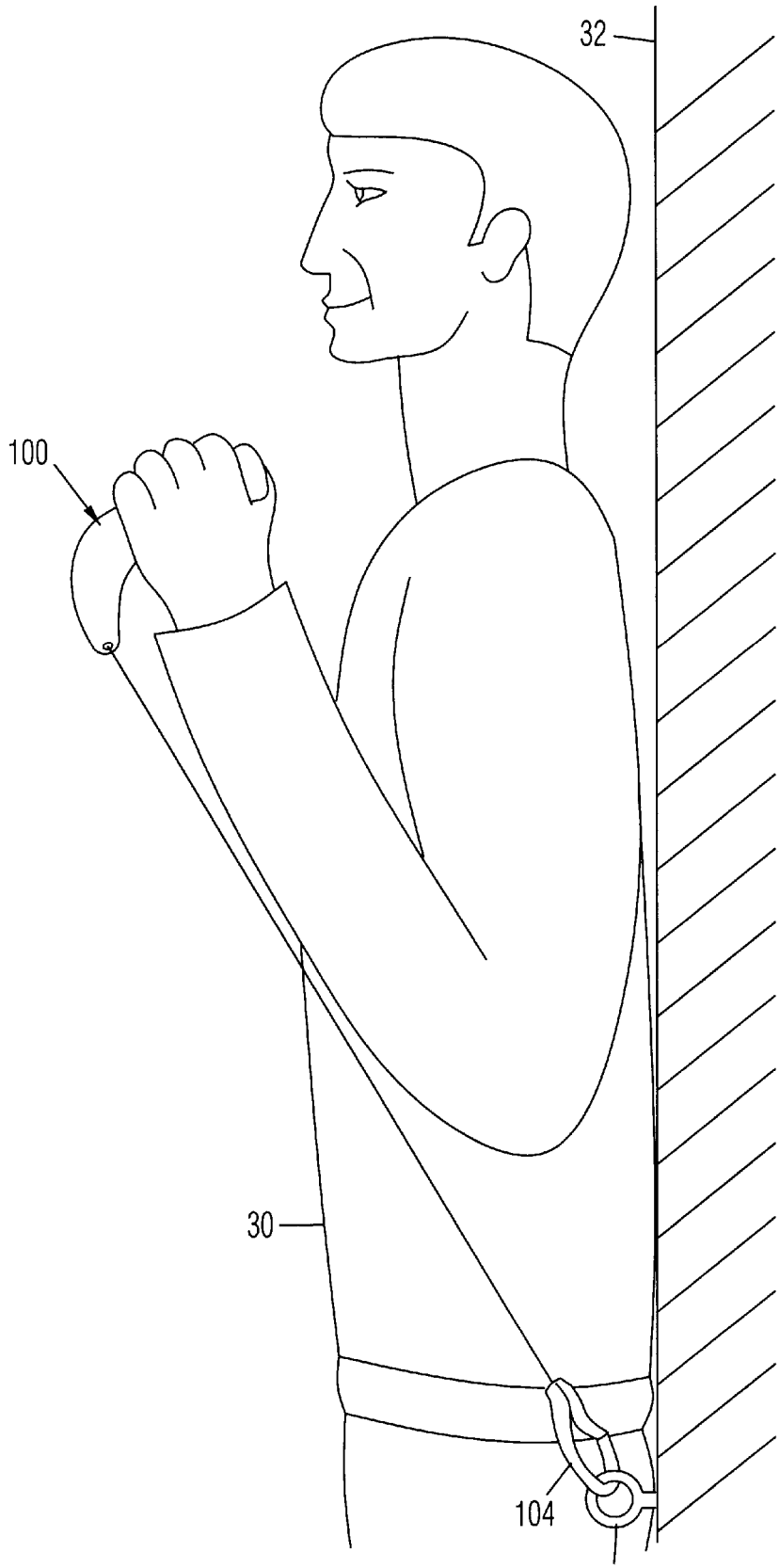
FIG. 2 is a side view of a person using the device of the present invention for doing compression type arm exercise.
Figure 3:
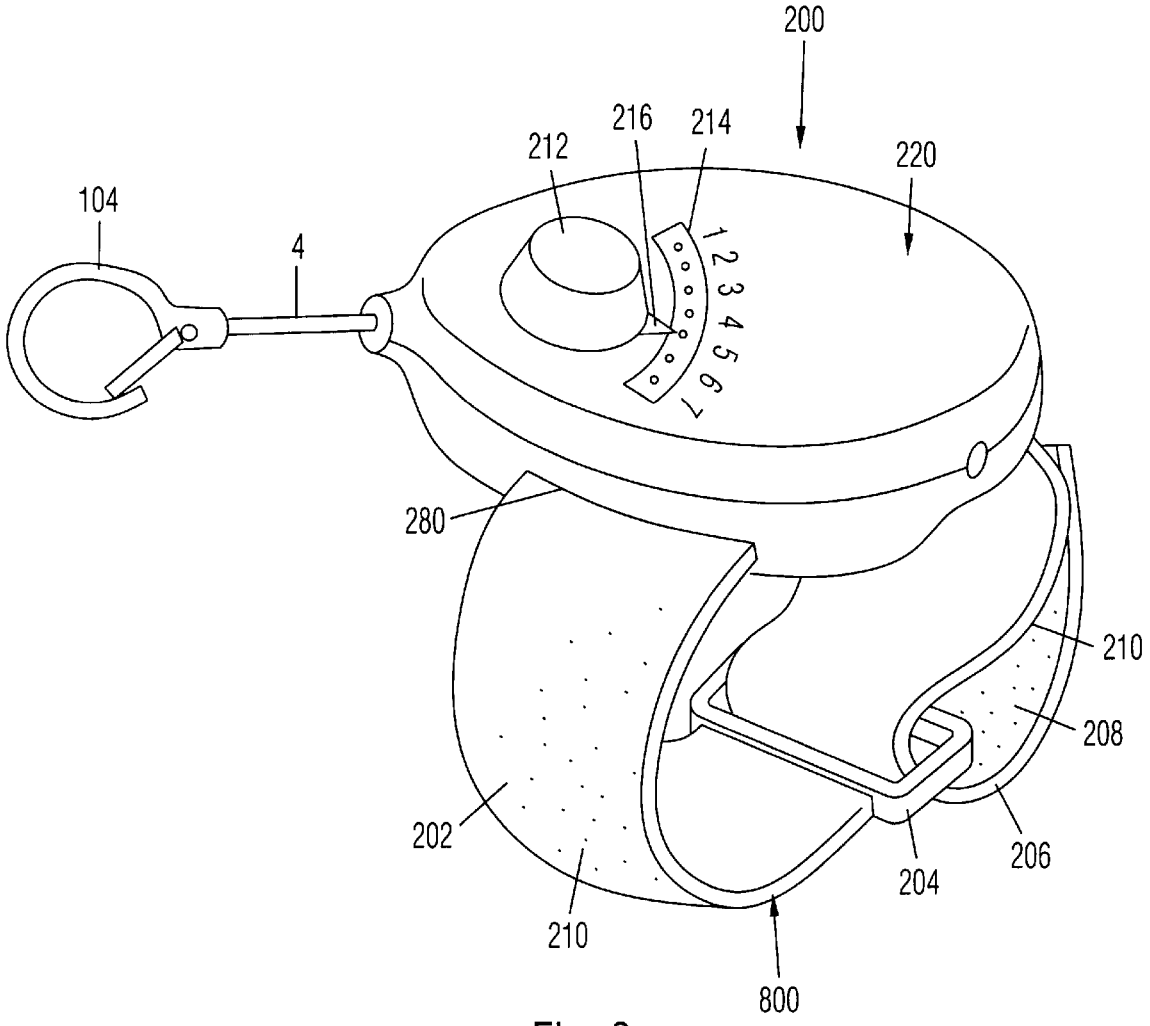
FIG. 3 is a perspective view of the variable resistance mechanism of the present invention.
Figure 4:
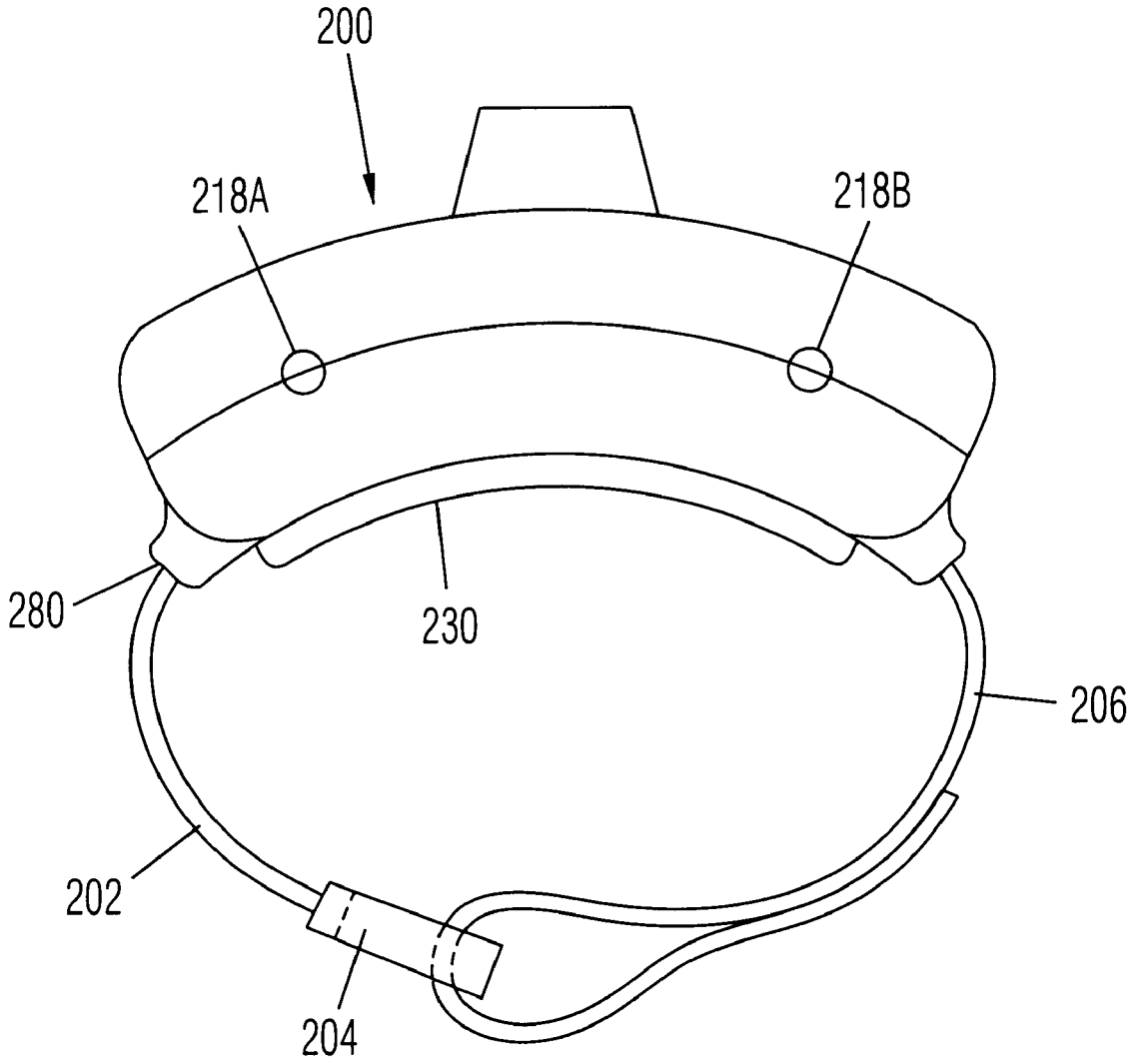
FIG. 4 is an end view of the variable resistance mechanism of the present invention.
Figure 5:
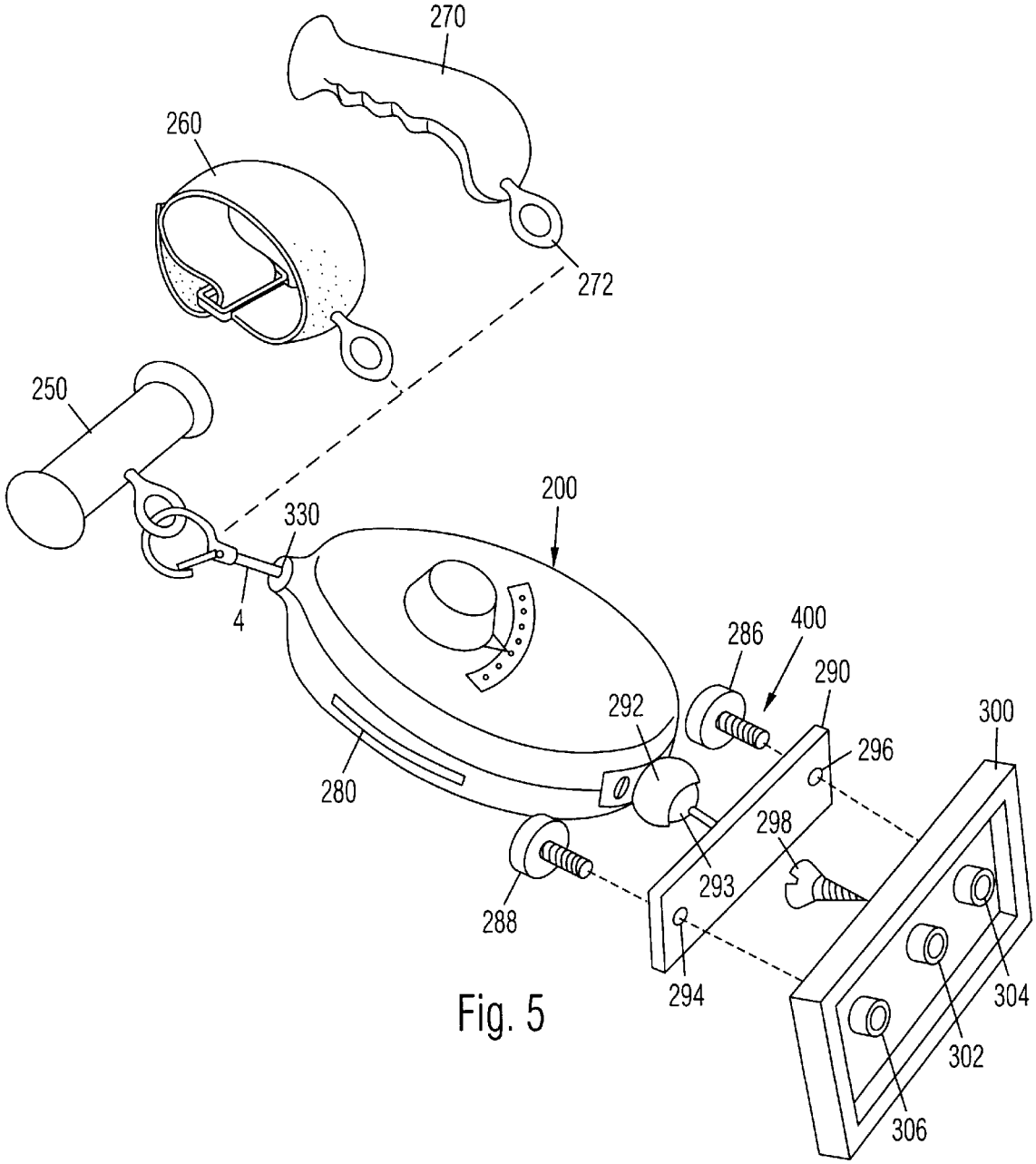
FIG. 5 is an exploded view of the present invention showing various mounting and attachment means.
Figure 6:
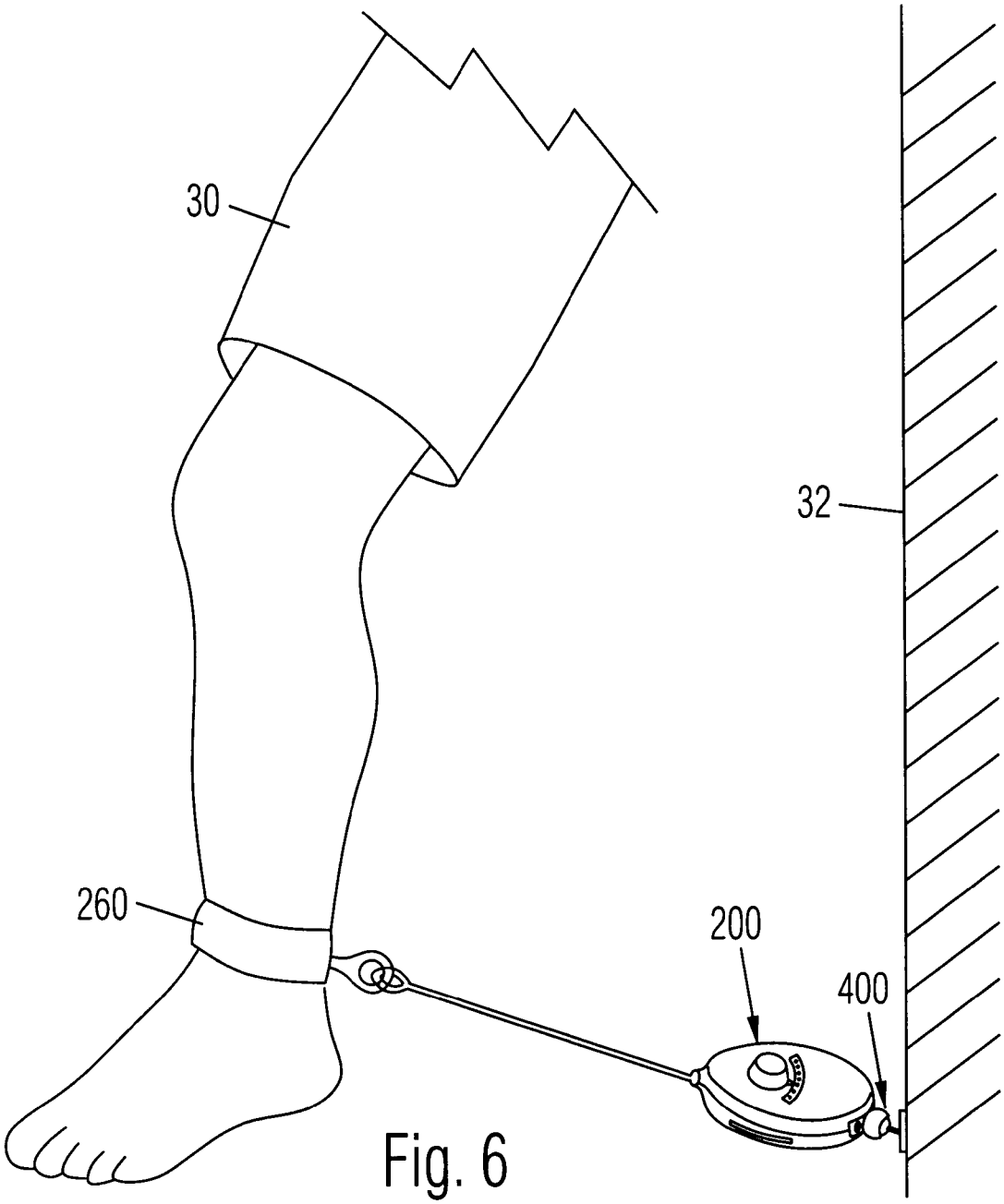
FIG. 6 is a perspective view of a person doing exercise where the variable resistance mechanism is attached to a wall.
Figure 7:
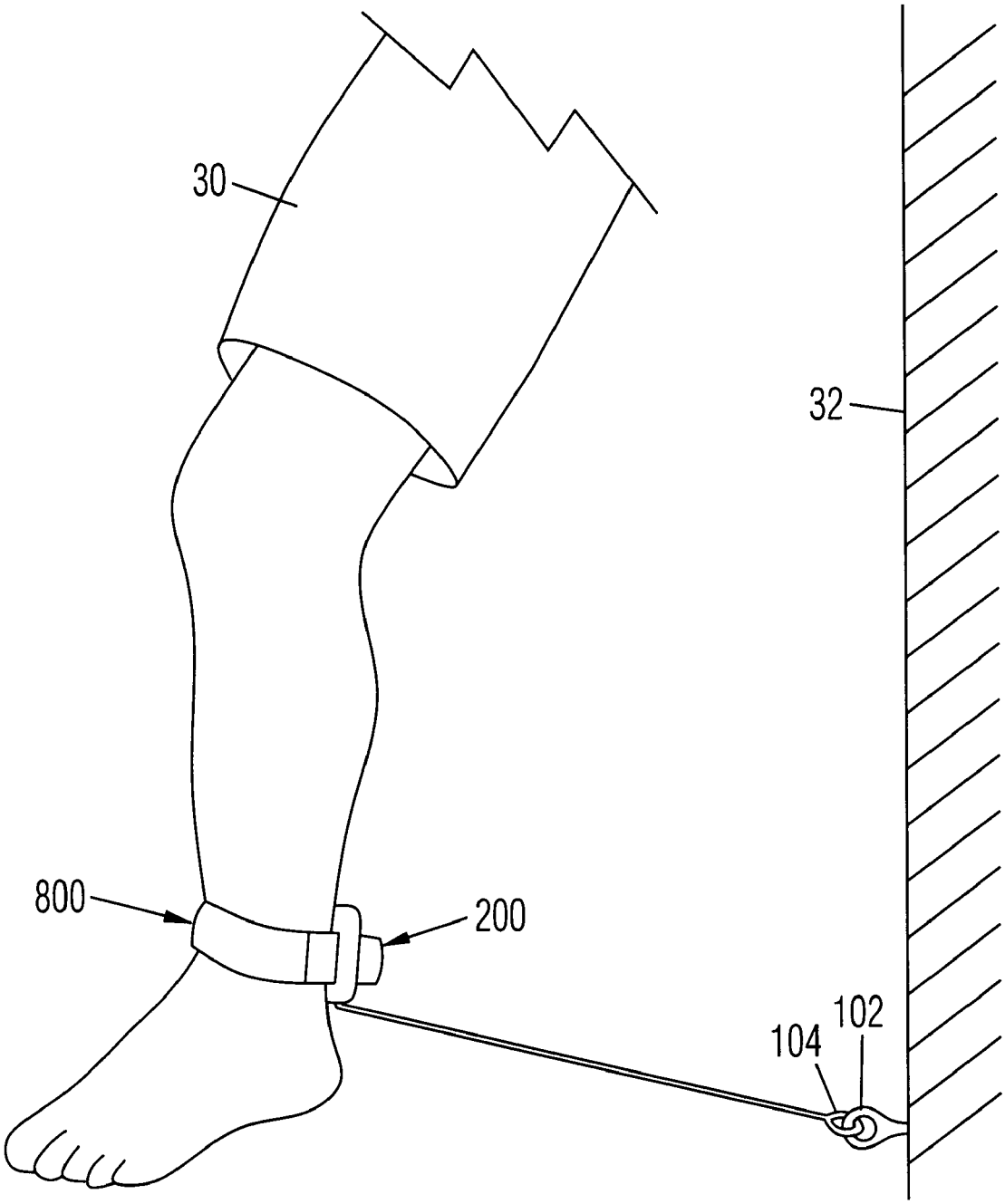
FIG. 7 is a perspective view of the present invention where the variable resistance mechanism is attached to the users leg.
Figure 8:
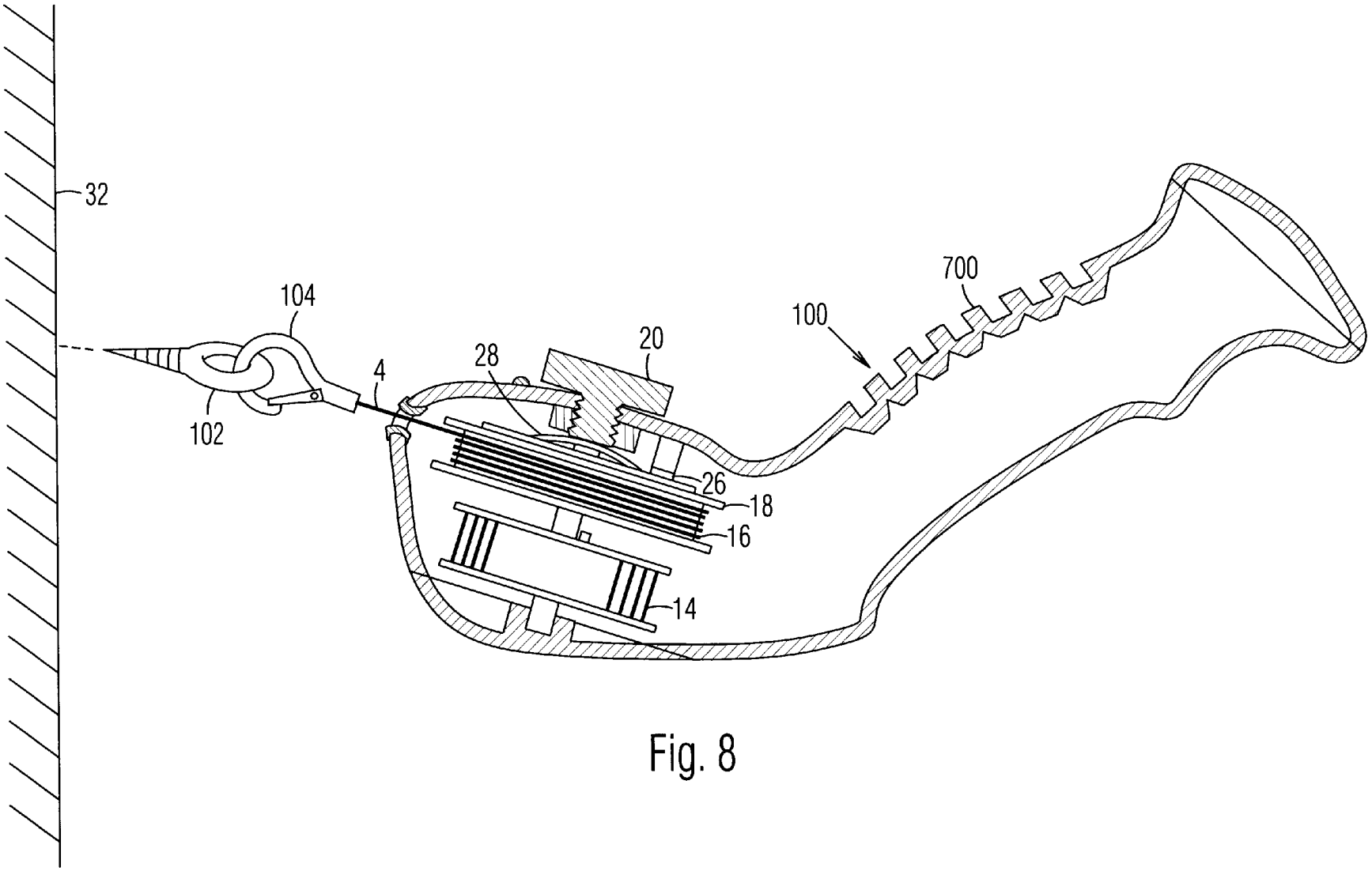
FIG. 8 is a side section view of the variable resistance mechanism.

Referring now to FIG. 1 we see a side view of a person 30 using the variable resistance device 100 of the present invention. The variable resistance device 100 has been fully described in my U.S. Pat. No. 5,876,310. Referring now to FIG. 8 in the present description we see a detailed view of the variable resistance mechanism 100 which is the same as the one used in U.S. Pat. No. 5,876,310 except that the cable 4 is attached to retaining clip 104 which is in turn attached to an eye bolt 102 that can be screwed into a wall 32 rather than being attached to a belt as described in my prior patent. The internal components however are similar. Spring reel 14 causes cable 4 to retract onto spool 16,18. A flexible spring plate 28 is pushed on by threaded knob 20 so that the further the knob is turned clockwise, the more resistance is put on the top surface 26 of spool 16,18 thereby making it harder for the user to pull on. The user grasps the hand grip 700 to use the device. In FIG. 1 the eye bolt 102 is mounted at shoulder height so that when the user pulls out on the resistance device 100 the forearm 32 is exercised. FIG. 2 2 shows eye bolt 102 attached to a wall 32 at hand level. In this configuration the users biceps muscles receive exercise. By placing eye bolt 102 at various levels, various different muscles can be exercised. FIG. 3 shows an embodiment of the variable resistance exercise device 200 in which a strap assembly 800 is incorporated so that the user can attach the resistance device 200 directly onto his or her wrist or leg. A larger strap could be used for attachment around ones mid section. Strap 800 is comprised of a strip 202 that exits from slit 280 in housing 220. One end of strap 202 terminates in a rigid buckle 204 and the other end 206 terminates in a hook type fastening material 208 which can mate with the loop type fastening material 210 that is found on the remainder of strap 202. The user can wrap the strap 202 around his or her arm or leg, insert it into buckle 204 and pull the strap 202 back on itself thereby tightly securing the resistance mechanism to ones arm or leg. The resistance element 220 works the same way as shown in FIG. 8 Knob 212 can be turned and arrow 216 shows the resistance setting on dial 214. FIG. 4 shows an end view of the variable resistance device 200. Padded cushion 230 interfaces with a persons arm or leg so that the device 200 remains comfortable even under resistive loads. Threaded holes 216,218 can receive an optional bracket 400 as shown in FIG. 5 Bracket 400 includes a ball 293 and socket 292 attached to a flat plate 290. This configuration allows the user to pull on the resistance device 200 at any angle without causing undue friction between the exit hole 330 and cable 4. Rigid bracket 300 is attached to a wall by screw 298. Bracket 400 can be removably attached to fixed bracket 300 by use of thumb screws 286,288. The user can then select between retaining means 250, 260 and 270 depending on the type of exercise being performed. Multiple brackets 300 can be mounted at various heights and positions on a wall to help the user exercise a wide variety of muscles including muscles in ones arms legs and chest. FIG. 6 shows a person performing a leg exercise by selecting retaining means 260 and wrapping it around his or her ankle. Resistance unit 200 be seen attached via mounting bracket assembly 400 to wall 32. FIG. 7 shows an alternate way of achieving the same exercise effect that is achieved in FIG. 6. In FIG. 7 the resistive device 200 is attached by strap assembly 800 to the users ankle. Eye bolt 102 is screwed into wall 32 and retaining clip 104 snaps onto eye bolt 102.

In the above described and illustrated way, a person can use a variable resistance exercise device in combination with an existing stationary wall to tone and strengthen many muscle groups in ones legs, arms and chest.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A variable resistance exercise device, comprising:

a resistance element housing;

a pair of slits on opposite sides of said housing;

a strap positioned through said slits in said housing;

wherein one end of said strap is fixed to a buckle, and an opposite end of said strap is looped through said buckle, curved back onto itself, and detachably secured to itself with hook-and-loop fasteners, said strap for strapping around a limb of a user;

a cable projecting from said housing under tension to retract into said housing;

a clip attached to an outer end of said cable;

an eye bolt for being attached to a wall; and wherein said clip is detachably connected to said eye bolt to anchor said outer end of said cable.

2. The variable resistance exercise device of claim 1, further including a plurality of additional eye bolts for being attached to different heights and positions on said wall, wherein said clip is attachable to selected ones of said eye bolts for exercising different muscles.

* * * * *